US011470433B2

(12) United States Patent
Gouin

(10) Patent No.: US 11,470,433 B2
(45) Date of Patent: Oct. 11, 2022

(54) CHARACTERIZATION OF REVERBERATION OF AUDIBLE SPACES

(71) Applicant: Johnson Controls Fire Protection LP, Boca Raton, FL (US)

(72) Inventor: Alexandre Gouin, Sainte Basile le Grand (CA)

(73) Assignee: Johnson Controls Fire Protection LP, Boca Raton, FL (US)

( * ) Notice: Subject to any disclaimer, the term of this patent is extended or adjusted under 35 U.S.C. 154(b) by 0 days.

(21) Appl. No.: 17/129,405

(22) Filed: Dec. 21, 2020

(65) Prior Publication Data

US 2022/0201414 A1 Jun. 23, 2022

(51) Int. Cl.

| | |
|---|---|
| ***H04R 29/00*** | (2006.01) |
| ***H04R 1/40*** | (2006.01) |
| ***G10L 25/51*** | (2013.01) |
| ***H04R 3/12*** | (2006.01) |
| ***H04R 3/00*** | (2006.01) |

(52) U.S. Cl.

CPC ..... *H04R 29/002* (2013.01); *G10L 25/51* (2013.01); *H04R 1/403* (2013.01); *H04R 1/406* (2013.01); *H04R 3/005* (2013.01); *H04R 3/12* (2013.01)

(58) Field of Classification Search

CPC ..... H04R 29/002; H04R 29/00; H04R 1/406; H04R 1/403; H04R 3/005; H04R 3/12

USPC ..... 381/56–57, 91–92, 83, 93, 77

See application file for complete search history.

(56) References Cited

U.S. PATENT DOCUMENTS

| | | | | |
|---|---|---|---|---|
| 8,103,007 | B2 * | 1/2012 | Shields | G10L 25/69 381/94.1 |
| 10,531,221 | B1 * | 1/2020 | Moore | H04S 7/303 |
| 2007/0147625 | A1 * | 6/2007 | Shields | H04R 29/007 381/57 |
| 2009/0220100 | A1 | 9/2009 | Ohta et al. | |
| 2017/0127206 | A1 * | 5/2017 | Skovenborg | G01H 7/00 |
| 2019/0394567 | A1 * | 12/2019 | Moore | H04R 1/403 |
| 2019/0394570 | A1 * | 12/2019 | Moore | H04S 7/303 |
| 2020/0314573 | A1 | 10/2020 | Dean-Bhiyan et al. | |
| 2020/0342846 | A1 * | 10/2020 | Cai | H04S 7/304 |

FOREIGN PATENT DOCUMENTS

KR 102098886 B1 4/2020

OTHER PUBLICATIONS

Extended European Search Report for European Patent Application No. 21214200.4, dated May 17, 2022 (34 pages).

* cited by examiner

*Primary Examiner* — Disler Paul

(74) *Attorney, Agent, or Firm* — ArentFox Schiff LLP

(57) ABSTRACT

A method and system for improving the intelligibility of an audio signal emitted from plural audio output devices in a space can help mitigate systems that have low intelligibility at installation due to reverberation effects; it can provide a quick post installation check of a system prior to a full-fledged STIPA (Speech Transmission Index for Public Address Systems) or equivalent test; and it allows for a quick verification if changes to the acoustical environment are expected to have major effects on STIPA tests.

22 Claims, 11 Drawing Sheets

| *Speaker* | *Default Settings* |
|---|---|
| S1 | 86 dBA |
| S2 | 86 dBA |
| S3 | 86 dBA |
| S4 | 86 dBA |
| S5 | 83 dBA |

| Speaker \ Microphone | M1 | M2 | M3 | M4 | M5 | M6 | M7 | M8 | M9 |
|---|---|---|---|---|---|---|---|---|---|
| S1 | 9.1 | 0.3 | 7.7 | 3.9 | 8.5 | 3.1 | 4.5 | 3.7 | 7.8 |
| S2 | | | | | | | | | |
| S3 | | | | | | | | | |
| S4 | | | | | | | | | |
| S5 | | | | | | | | | |

| Speaker \ Microphone | M1 | M2 | M3 | M4 | M5 | M6 | M7 | M8 | M9 |
|---|---|---|---|---|---|---|---|---|---|
| S1 | 9.1 | 0.3 | 7.7 | 3.9 | 8.5 | 3.1 | 4.5 | 3.7 | 7.8 |
| S2 | 5.5 | 6.4 | 0.0 | 8.2 | 4.4 | 2.5 | 0.9 | 2.7 | 5.2 |
| S3 | | | | | | | | | |
| S4 | | | | | | | | | |
| S5 | | | | | | | | | |

| Speaker \ Microphone | M1 | M2 | M3 | M4 | M5 | M6 | M7 | M8 | M9 |
|---|---|---|---|---|---|---|---|---|---|
| S1 | 9.1 | 0.3 | 7.7 | 3.9 | 8.5 | 3.1 | 4.5 | 3.7 | 7.8 |
| S2 | 5.5 | 6.4 | 0.0 | 8.2 | 4.4 | 2.5 | 0.9 | 2.7 | 5.2 |
| S3 | 6.4 | 2.0 | 1.0 | 8.2 | 3.7 | 7.8 | 1.1 | 1.2 | 7.3 |
| S4 | 8.8 | 8.7 | 7.5 | 0.7 | 0.4 | 8.3 | 2.3 | 8.5 | 3.8 |
| S5 | 4.9 | 3.5 | 3.2 | 3.0 | 2.3 | 2.7 | 4.8 | 3.0 | 2.9 |

| Speaker \ Index Function | Min | Max | Avg | Median | Weighted Avg $\sum(R_i \times P_i) / \sum P_i$ |
|---|---|---|---|---|---|
| S1 | 0.3 | 9.1 | 5.9 | 7.7 | 7.0 |
| S2 | 0.0 | 8.2 | 4.9 | 5.5 | 5.4 |
| S3 | 1.0 | 8.2 | 4.3 | 3.7 | 3.5 |
| S4 | 0.4 | 8.8 | 5.2 | 7.5 | 5.5 |
| S5 | 2.3 | 4.9 | 3.4 | 3.2 | 3.6 |

Fig. 5

| Speaker | Default | Index Value | Adjustment | Adjusted SPL |
|---|---|---|---|---|
| S1 | 86 dBA | 7.7 | -7 dB | 79 dBA |
| S2 | 86 dBA | 5.5 | -3 dB | 83 dBA |
| S3 | 86 dBA | 3.7 | +4 dB | 90 dBA |
| S4 | 86 dBA | 7.5 | -7 dB | 79 dBA |
| S5 | 83 dBA | 3.2 | +4 dB | 87 dBA |

Fig. 6

| Speaker \ Alert Type | 520 Hz | Siren | Bell | Voice | Music |
|---|---|---|---|---|---|
| S1 | 78 dBA | 90 dBA | 90 dBA | 68 dBA | 42 dBA |
| S2 | 79 dBA | 91 dBA | 92 dBA | 69 dBA | 42 dBA |
| S3 | 80 dBA | 91 dBA | 91 dBA | 69 dBA | 43 dBA |
| S4 | 71 dBA | 91 dBA | 90 dBA | 65 dBA | 42 dBA |
| S5 | 72 dBA | 88 dBA | 0 dBA | 60 dBA | 41 dBA |

Table 10-1 - Microphone1

| Reverb (s) | SPL (dBA) |
|---|---|
| 9.1 | 57 |
| 5.5 | 49 |
| 6.4 | 21 |
| 8.8 | 76 |
| 4.9 | 97 |

Table 10-3 - Microphone3

| Reverb (s) | SPL (dBA) |
|---|---|
| 7.7 | 15 |
| 0.0 | 13 |
| 1.0 | 12 |
| 7.5 | 64 |
| 3.2 | 17 |

Table 10-5 - Microphone5

| Reverb (s) | SPL (dBA) |
|---|---|
| 8.5 | 12 |
| 4.4 | 85 |
| 3.7 | 48 |
| 0.4 | 80 |
| 2.3 | 77 |

Table 10-2 - Microphone2

| Reverb (s) | SPL (dBA) |
|---|---|
| 0.3 | 14 |
| 6.4 | 98 |
| 2.0 | 39 |
| 8.7 | 79 |
| 3.5 | 52 |

Table 10-4 - Microphone4

| Reverb (s) | SPL (dBA) |
|---|---|
| 3.9 | 18 |
| 8.2 | 22 |
| 8.2 | 3 |
| 0.7 | 46 |
| 3.0 | 24 |

Fig. 10

CHARACTERIZATION OF REVERBERATION OF AUDIBLE SPACES

BACKGROUND

In emergency systems, such as fire detection, mass notification, security and building management systems, certain announcements may issue from multiple audio output devices, e.g., speakers, to alert people present in certain areas of the current dangers, direct them to a safe place, etc. Other sounds such as sirens, whoops and the like may also be broadcast to get people's attention.

In order to meet safety requirements, it is often necessary to have multiple audio output devices in a given area (zone) and it is desirable to ensure that one or more spots (locations) within the area receive a minimum sound pressure level or SPL to ensure that anyone within the area hears the announcement or warning signal. However, in large spaces, such as building foyers, office spaces, sports and entertainment venues, mass transit stations and airports, etc., there may be so much reverberation that it is near impossible to understand any vocal messages or even understand what sound is being broadcast throughout the space.

FIG. 9 is a graph 900 illustrating this issue for just two speakers, Speaker 1 and Speaker 2. The curve representing SPL vs. time for Speaker 1, as detected by a microphone at some location, is represented as a solid line 910, while the curve representing SPL vs. time for Speaker 2, as detected by the microphone at the same location, is represented as a dashed line 920. Although the two curves 910, 920 are shown over the same time period, it should be appreciated that Speaker 1 and Speaker are actually tested at different times. The graph 900 designates the starting test time for each speaker as 0 seconds.

As can be seen, a test signal (not shown) is emitted from Speaker 1 at time t=0.1 sec, and the SPL detected at the microphone rises to a peak at t=0.2 sec. At t=0.3 sec, Speaker 1 is turned off, but the microphone picks up reverberation with a slow decay that extends beyond 1.3 sec. This process is repeated for Speaker 2. The same test signal is emitted from Speaker 2 at time t=0.1 sec; the SPL detected at the microphone picks up reverberation, but for Speaker 2, the reverberation decays much faster than for Speaker 1, virtually disappearing by t=0.8 sec.

Note that these values are for illustrative purposes only. In some cases reverberation could last seconds. This test is to measure the amount of reverberation for each speaker as detected at the microphone location. Of course, in real life, the reverberation begins immediately and the emergency signal or message lasts for seconds or longer, so that the worse the reverberation is the more it muddies the actual signal being emitted.

SUMMARY

Embodiments of the present invention can help mitigate systems that have low intelligibility at installation due to reverberation effects; it can provide a quick post installation check of a system prior to a full-fledged STIPA (Speech Transmission Index for Public Address Systems) or equivalent test; and it allows for a quick verification if changes to the acoustical environment are expected to have major effects on STIPA tests.

In accordance with aspects of the invention, a method for improving the intelligibility of an audio signal emitted from plural audio output devices in a space comprises a) selecting and b) generating a test signal; c) selecting an audio output device from a set of audio output devices; d) converting the generated test signal to an audio test signal at the audio output device at a predetermined sound pressure level (SPL); and e) for each microphone of a group of microphones, each having a corresponding location, converting sound to an electrical signal at each microphone, and determining from the electrical signal an amount of reverberation of the audio test signal at the microphone's location. f) Steps c, d and e are repeated for each audio output device from the set of plural output devices; and g) the SPL settings of the selected audio output devices are adjusted based on the determined amounts of reverberation.

In an embodiment, in step a, the test signal is selected from a set of test signals, each signal corresponding to a particular condition from a set of conditions. In step d, the predetermined SPL for the selected audio output device corresponds to the particular condition and in step g, the SPL settings are adjusted based on the particular condition. Steps a through g may be repeated for each condition from the set of conditions. The various conditions include, but are not limited to: fire alarm; intrusion alert; active shooter; weather warnings; background music; or general announcements. Test signals may include, but are not limited to: a slow whoop; a fast whoop; a horn; a bell; voice; or music. Audio output devices may include, but are not limited to: a speaker; a horn; a bell; a siren; or a buzzer.

In further embodiments, adjusting the SPL settings comprises lowering the SPL setting of the audio output device with greatest reverberation, and/or raising the SPL setting of audio output device with least reverberation.

In yet another embodiment, the selected group of microphones is located within a predetermined area or space or zone. In some embodiments, one or more microphones may be collocated with an audio output device, for example a fire alarm notification appliance with a built-in microphone.

In another embodiment, a system for improving the intelligibility of an audio signal emitted from plural audio output devices in a space comprises: a control panel; an audio test signal generator; plural speakers located in a zone; an audio signal analyzer; and one or more microphones placed at one or more locations within the zone. The control panel may be configured to generate a test signal, select a speaker, and cause the selected speaker to emit, based on the generated test signal, an audio test signal at a predetermined sound pressure level (SPL). Each microphone may be configured to detect sound, convert its respective detected sound to a respective electrical audio signal, and send its respective electrical audio signal to the audio signal analyzer. The audio signal analyzer may be a discrete unit or may be distributed within other parts of the system, and may be configured to determine an amount of reverberation of the audio test signal at each microphone, and based on the amount of reverberation at each microphone, determine a SPL setting for the selected speaker.

The audio test signal generator may be any of a fire alarm control panel, an audio signal generator, or one or more of said plural speakers.

The determined SPL may be chosen to optimize the intelligibility of audio warnings.

The control panel may be further configured to adjust the selected speaker's SPL setting based on the determined SPL.

Further, a method for improving the intelligibility of an audio signal emitted from plural audio output devices in a space may include the steps of: a) sequentially sounding an audible test signal from plural audio output devices; b) at each of one or more locations, measuring a reverberation time of the sounded audible test signal for each audio output device; and c) adjusting an output SPL of at least one of the audio output devices in response to the measured reverberation times.

In another embodiment, a method may comprise the additional steps of: d) simultaneously sounding the audible test signal from the plural audio output devices; e) at each location, measuring a total SPL of the sounded audible test; and f) adjusting an output SPL of at least one of the audio output devices in response to the measured total SPL and at least one of the audio devices' measured reverberation time.

Adjusting an output SPL of at least one of the audio output devices includes deriving an index value from the reverberation times measured at each of the locations for the audio output devices, and at least one of: raising the output SPL of said audio output device having an index value indicative of a shortest total reverberation time; and lowering the output SPL of said audio output device with an index value indicative of a longest total reverberation time.

Further, steps a through c may be repeated for each of plural audible test signals, each audible test signal corresponding respectively to at least one plural audible output types. Plural audible output types may include, but are not limited to, a buzzer, bell, siren, whoop, voiced public announcement, or background music. Further still, a set of SPL values may be maintained for each audible output type.

In yet another embodiment, a system for improving the intelligibility of an audio signal emitted from plural audio output devices in a space comprises: a controller; plural audio output devices controlled by the controller; a memory for storing SPL settings for each of the audio output devices for each of at least one or more audio alert types; and an audio sensor at each of one or more locations. The controller may cause each of the plural audio output devices to sequentially sound an audible test signal. At each of one or more locations, a reverberation time of the sounded audible test signal may be measured for each audio output device; and an output SPL setting of at least one of the audio output devices may be adjusted in the table in response to the measured reverberation times.

The controller may be, but is not limited to, one or a combination of any of a fire alarm control panel, an intrusion control panel, a security control panel, or a building management system control panel.

The table may be stored in and maintained by the controller.

BRIEF DESCRIPTION OF THE DRAWINGS

FIG. 5 Is a table showing examples of indices based on a plurality of sound input devices to a given sound output device and derived from various algorithms or mathematical functions.

FIG. 6 is table providing illustrative examples of speaker SPL adjustments based on a "median" index for each speaker.

FIG. 10 is collection of tables providing, for illustrative purposes measured values of reverberation and SPL for each speaker as detected by each microphone.

DESCRIPTION

Figure 1:
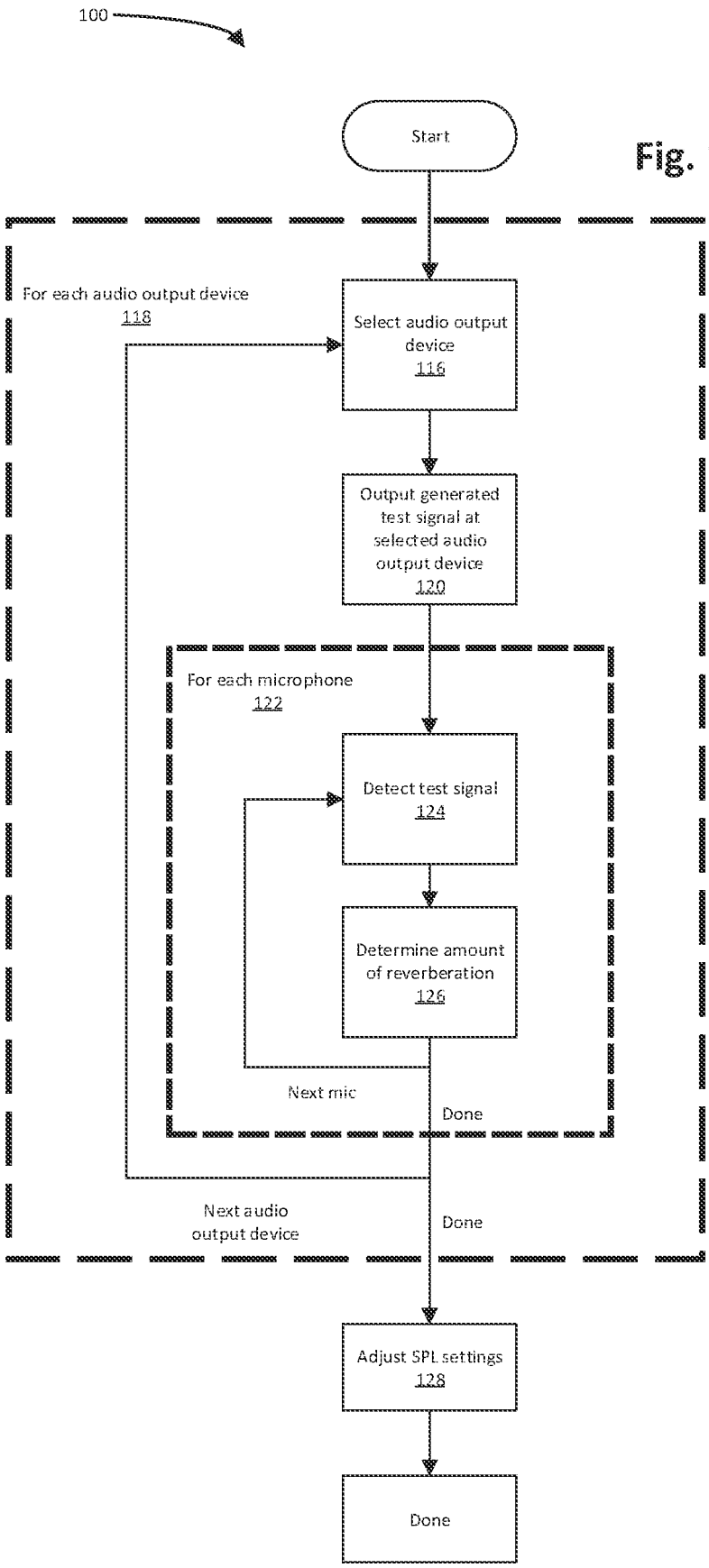
FIG. 1 is a flowchart illustrating an exemplary method according to an embodiment of the present invention for improving intelligibility due to reverberation effects.

For convenience, the description herein is directed to fire alarm systems, but it should be understood that the principles of the invention may be applied equally well to other emergency notification systems, including but not limited to: evacuation, security, building management and public address systems. By using microphones in a building when a fire alarm system is installed or any time thereafter when major acoustical changes warrant a retest, a fire alarm control unit may be used to individually drive fire alarm voice evacuation speakers to characterize audible zones where they are used. By measuring parameters such as the reverberation time which affects the intelligibility of voice signals, a speaker array may be tuned to minimize reverberation. If for example some speakers by their placement near some materials create a more disruptive reverberation than other speakers, these speakers may be tuned out in favor of others nearby to control the overall reverberation times. By measuring reverberation times, the test can be concluded quickly without full length tests as only a short audio burst from each speaker need be sent. Controlling each real speaker to produce sound thus creates a true representation.

Embodiments of the present invention determine which speakers in the array of speakers generate the most reverberation and reduce the sound output level of those speakers. Alternatively, or in addition, embodiments of the present invention may determine which speakers in the array generate the least reverberation and may raise the sound output level of those speakers.

For example, if there are five speakers serving one gymnasium but one of them is placed closer to a glass wall, that speaker may generate more reverberation than any of the other speakers. As such, even though the speaker is physically installed, the total intelligibility in the room can be optimized by decreasing its sound output compared to the original planned (or default) output power.

Microphones may be positioned in predetermined locations where it is expected that people can hear and make sense of important aural emergency signals such as voice announcements or other sounds; for example a horn, a bell, a fast or slow whoop or other important aural signals. Furthermore, it may be desirable to reduce reverberation levels for non-emergency sounds such as background music.

As an example, a system with five speakers may designate a default setting of 80 dBA for each of the speakers. After determining that the reverberation at any given place in the gymnasium can be improved if speaker 4 outputs less power, its output power can be lowered to a value of 75 dBA, or it may be entirely disabled. Of course, there are still requirements to be met in life safety situations such as a minimum sound output but that can be verified subsequently by, for example, the method and system described in U.S. patent application Ser. No. 16/698,334, filed on Nov. 27, 2019, and which is incorporated herein in its entirety.

In the end, the goal is to determine which speakers are the most problematic once installed and to lower their intensity (sound pressure level) starting with the worse one. Outside of life safety requirements (such as when speakers are used for public address), the methods and systems described herein may determine that in disabling some speakers, though the system no longer produces a life-safety-required sound pressure level, it is still adequate and much more intelligible.

In its most basic form, we simply lower the volume of the speaker or speakers that cause the most reverberation. If after lowering the output level of one or more speakers, the required SPL is not met, the output level of the least offensive speakers may be increased.

Reverberation measurements may be performed using any known means, for example: by emitting short pulses of certain frequencies in a given speaker and measuring how long it takes before the pulses fully decay; by generating and stopping wide band frequencies noise such as pink or white noise.

The system may have individual control of each speaker, the goal being to maximize the intelligibility of any vocal announcement or other aural signals by tuning out the most offensive speakers in favor of those better suited.

Alternatively, the system may provide a report that installers can follow. Such a report might state, for example, "speaker 4, 7 and 8: adjust down to ½ W tap and retest". An installer may then climb a ladder to access the speaker, change the setting and restart the test. Then it can iteratively optimize the setting until a practical minimum gain is achieved, i.e. no further adjustments are required once reverberation cannot be reduced by more than, say, 10%.

FIG. 1 is a flowchart 100 illustrating an exemplary method for improving intelligibility due to reverberation effects according to an embodiment of the present invention. The steps shown within box 118 are repeated for each audio output device. In step 116, one of plural audio output devices is selected. The selected test signal is then audibly broadcast from the selected audio output device (step 120).

For each microphone (box 122), the broadcast test signal is detected (step 124) and the amount of reverberation detected at that microphone is determined (step 126). Note that the steps within box 122 may be done simultaneously for each microphone or serially for one microphone after another, or some combination thereof. In fact, one or more portable microphones (that is, not permanently affixed to any part of the building structure) may be moved from one location to another, thus virtually being multiple microphones.

The steps within box 118 may be repeated for each audio output device. After all output audio devices in the area of interest have been tested, the SPL settings for some or all of the audio output devices may be adjusted (step 128) based on the amount of reverberation detected at the various microphone locations.

Some or all of the steps in FIG. 1 may be performed from a control panel such as a fire alarm control panel. Alternatively, a separate controller/analyzer unit in communication with the control panel may perform some or all of the steps in FIG. 1. The control panel or the controller may control and communicate with each audio output device via wired and/or wireless connections and may similarly receive audio signals from the microphones over wired and/or wireless connections.

Figures 4A, 4B:
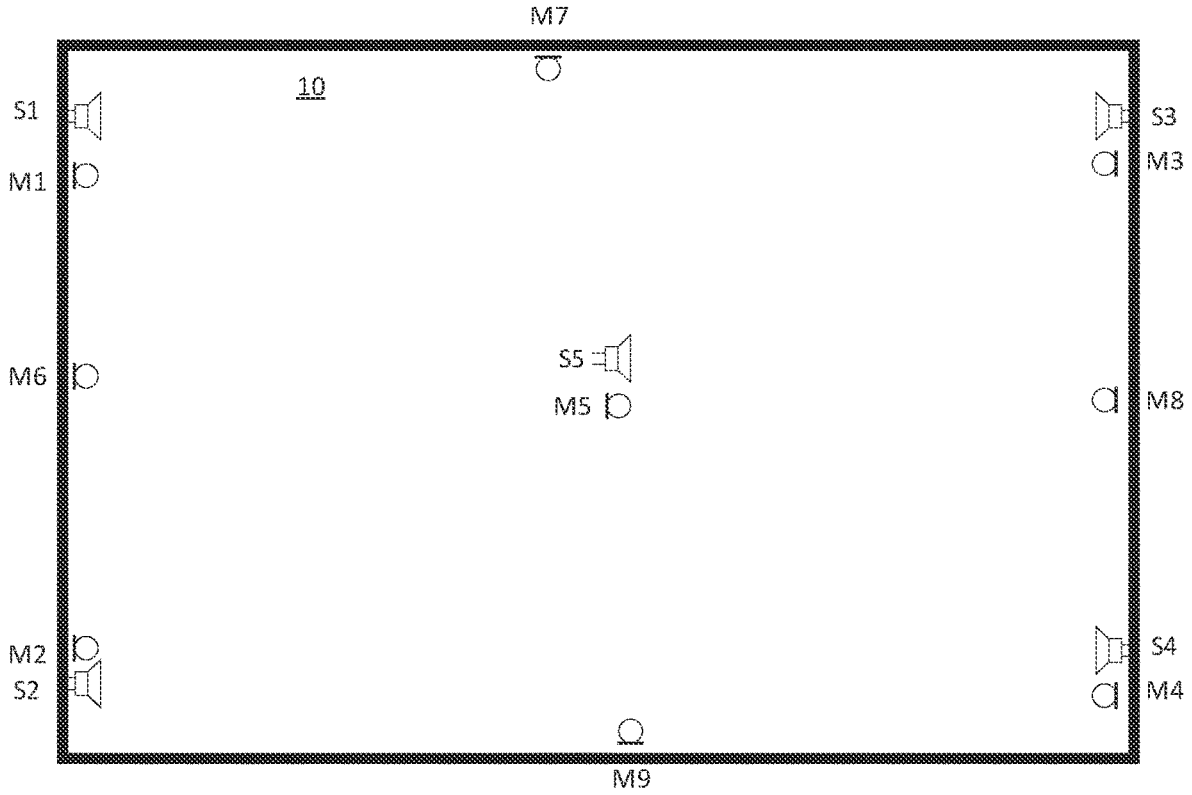
FIGS. 4A-4H are drawings that illustrate various aspects of the present invention in an exemplary space or zone.

FIG. 4A provides an example, not to be considered limiting, of the invention in an exemplary space 10, having five speakers or other audio output devices (S1 through S5) and nine audio input devices, e.g., microphones (M1 through M9). Some of the microphones (M1 through M5) are paired with the speakers and may reside in the same notification device. On the hand, some or all of the microphones may be permanently or temporarily placed at locations where measurements are desired. Note that each measured reverberation is tied to a speaker/microphone pair; that is, each microphone will see a different reverberation value depending on its position with respect to the activated speaker.

Prior to any testing, each speaker may be assigned a default sound pressure level (SPL) such as is shown in the table of FIG. 4B.

Figures 4C, 4D:
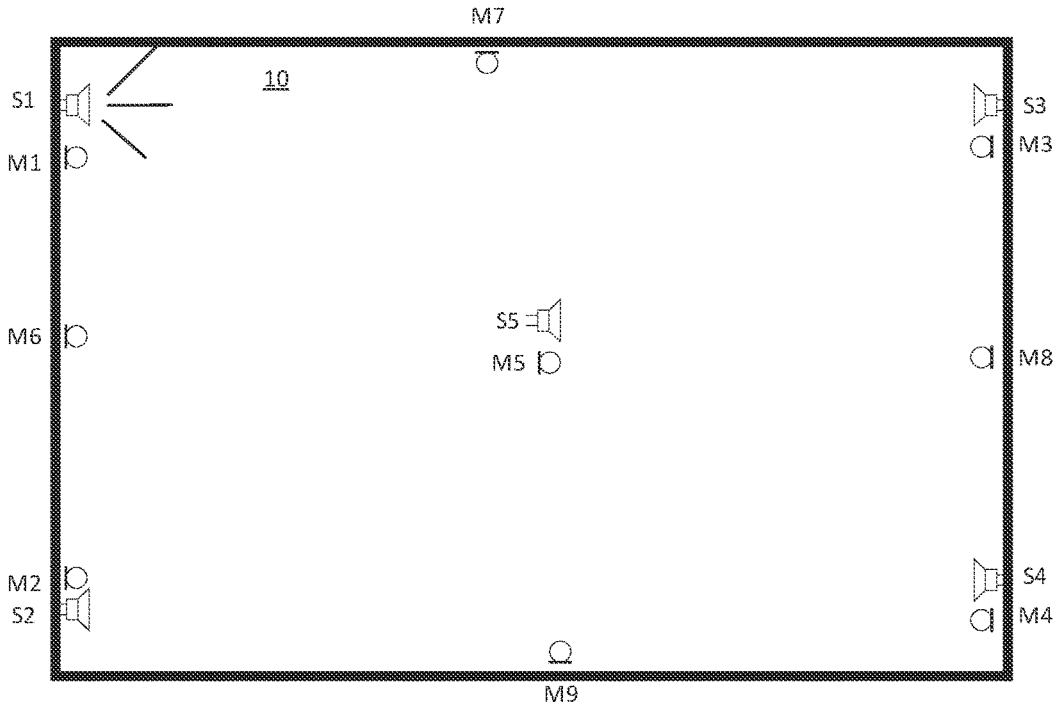

As depicted in FIG. 4C and in accordance with step 116 of FIG. 1, speaker S1 is selected for testing and the test signal is emitted from speaker S1 (FIG. 1 step 120). Each microphone M1-M9 may pick up the audible test signal (step 124) and the control panel or analyzer may receive the detected signals from each microphone and determine the length of the reverberation detected at each microphone (step 126). That is, steps 124 and 126 are performed for each microphone. Box 122, which encompasses both steps 124 and 126, is performed for each microphone, and may be performed simultaneously for each microphone, sequentially, or a combination. The reverberation times measured for each microphone with speaker S1 activated may then be stored, as illustrated in the table of FIG. 4D. For example, with speaker S1 activated, the reverberation detected by microphone M1 was found to last 9.1 seconds, the reverberation detected by microphone M2 lasted for 0.3 seconds, and so on. Note that these values are for illustrative purposes only.

Figures 4E, 4F:
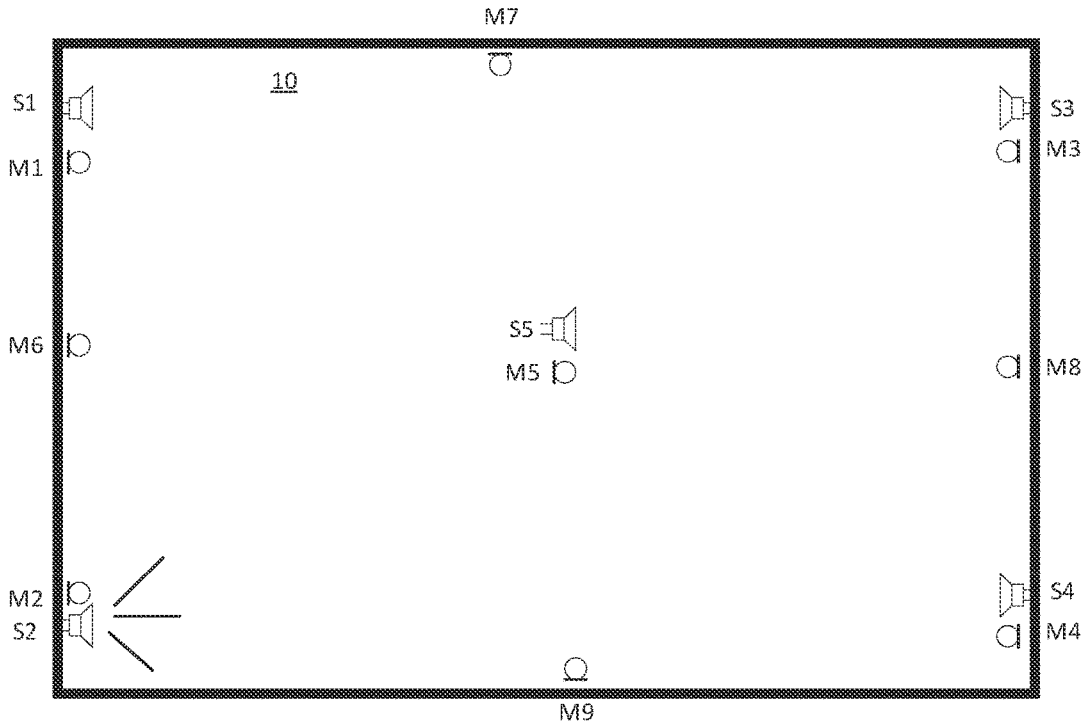

This process (all steps inside box 118) may then be repeated for speaker S2. For example, as illustrated in FIG. 4E, speaker S2 is activated. Again, reverberation measurements are determined for each of the microphone locations and then recorded for speaker S2 as shown in the table of FIG. 4F.

Figures 4G, 4H:
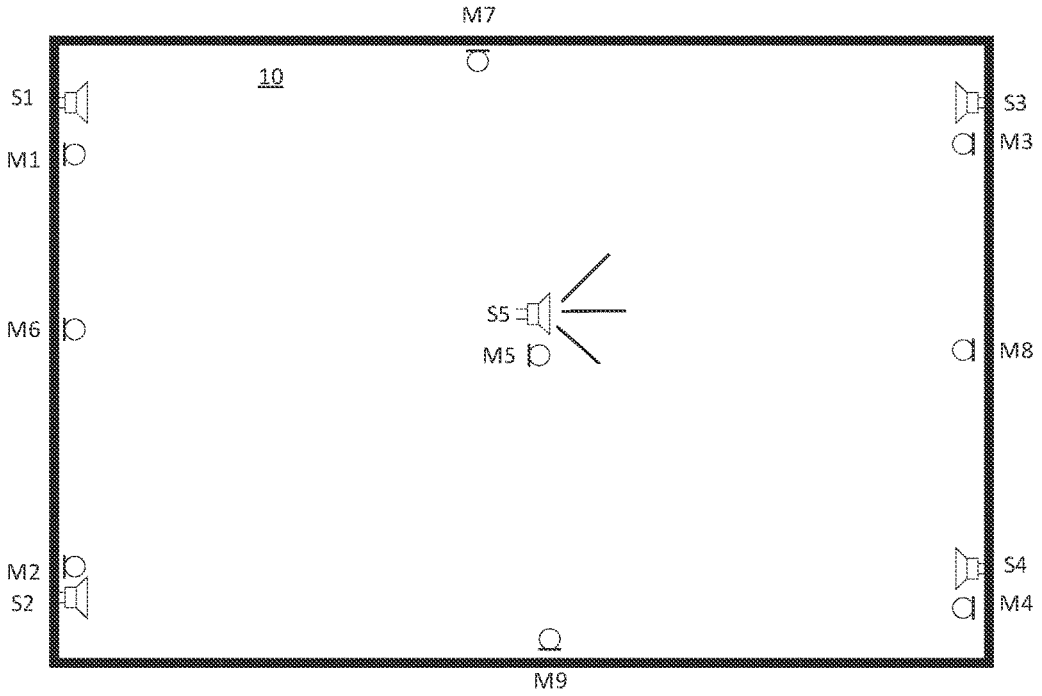

Process 118 may be repeated for the remaining speakers S3-S5, until all speakers' reverberations have been recorded. As shown in FIG. 4G, the last speaker, here S5, has been activated and the reverberation measurements at each microphone location recorded for speaker S5. FIG. 4H is a table illustrating the recorded values for each speaker at each microphone location after all of the speakers have been tested.

Finally, at step 128, the measurements are compared, and a reverberation index may be calculated for each speaker. For example, the index for each speaker may be calculated as the average of all the microphone readings associated with that speaker, or it may be calculated as the median of those readings, or the maximum or minimum. Using the reverberation values shown in FIG. 4H, The table of FIG. 5 illustrates the alternative indexes for each speaker, derived from the reverberation values shown provided in FIG. 4H, for each of several different algorithms that may be used. For example, again referring back to the table of FIG. 4H, it can be seen that the minimum reverberation time for speaker S1 was detected by microphone M2, i.e. 0.3 seconds. So using a min( ) function, the index for speaker S1 would be 0.3. Alternatively, if a max( ) function is employed instead, then the maximum reverberation for speaker S1 is 9.1 seconds as detected at microphone M1, and so the index would be 9.1. And so on for averaged, median( ) and other functions.

It is only necessary to calculate the index determined by the chosen method (or function or algorithm); however, for illustrative purposes, the results of five types of functions are shown. Of course, the index calculation is not limited to just these functions and may be derived from a variation of one or more of these functions, or from an entirely different function, or from a combination of functions.

A weighted average may be based on, e.g., the measured SPL and reverberation time combined. For example, a microphone registering 10 dBA with reverberation time of 9.0 seconds may be undesirable, but it may be relatively insubstantial if all of the other microphones register an SPL of 85 dBA and reverberation time of 0.1 s because the influence of the low SPL/high reverberation time will not be largely heard.

For example, the microphones (or analyzer) may record not just the length of reverberation detected at each microphone location, but also the SPL at each location. Tables 10-1 through 10-5 of FIG. 10 provide illustrative values. Table 1 illustrates exemplary detected reverberation durations and SPLs as for each of five audio output devices as detected by a first microphone Microphone 1, and so on.

Alternatively, outlier measurements that are below a certain threshold, for example 40 dBA, or the lowest measurement(s), could be ignored as irrelevant.

The speaker(s) with the highest index may have their SPL levels lowered (softer) while the speaker(s) with the lowest index may have their SPL levels adjusted higher (louder). FIG. 6 is a table that provides illustrative adjustments based on a "median" index for each speaker.

Some types of emergency signals must meet certain standards. For example, the NFPA may require that a signal alarm must be at a SPL level of at least 96 dBA at every location tested; however it is possible that after all the adjustments are made to reduce reverberation (FIG. 1, step 128), this requirement may not be met.

Figure 2:
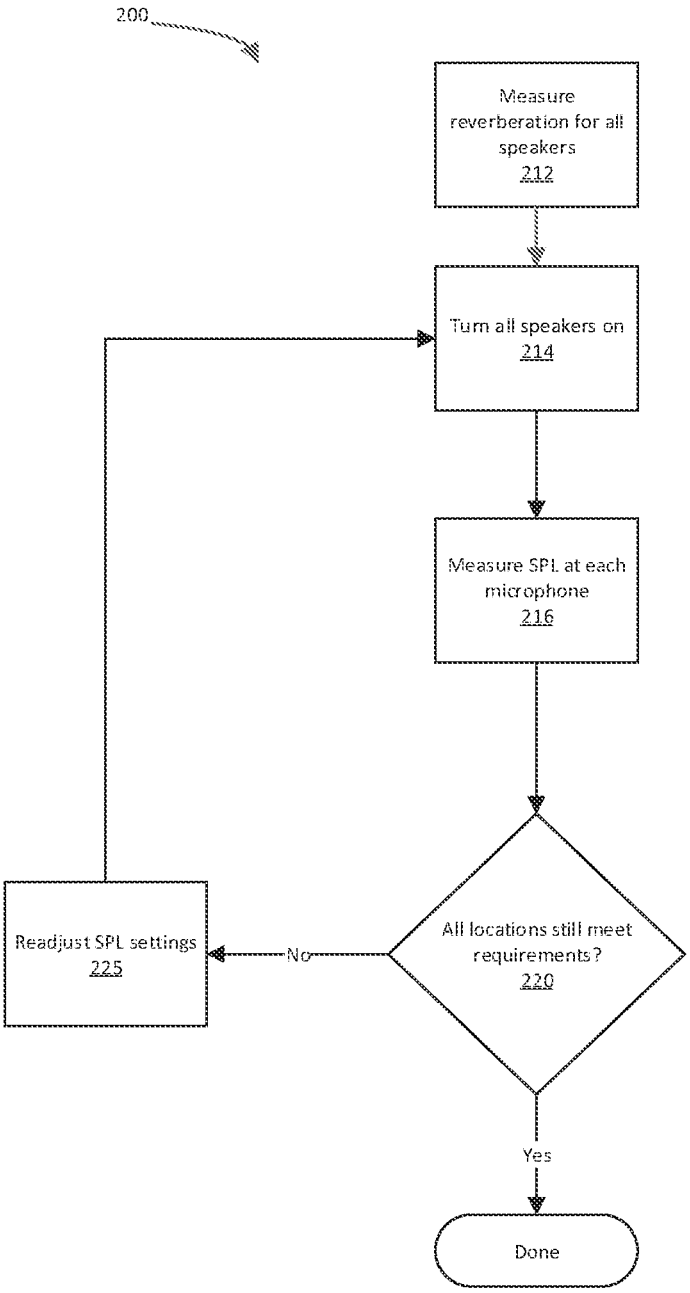
FIG. 2 is a flowchart illustrating a process according to an embodiment of the present invention for ensuring that the total sound pressure level (SPL) detected at any location in a zone meets any requirements.
Figure 7:
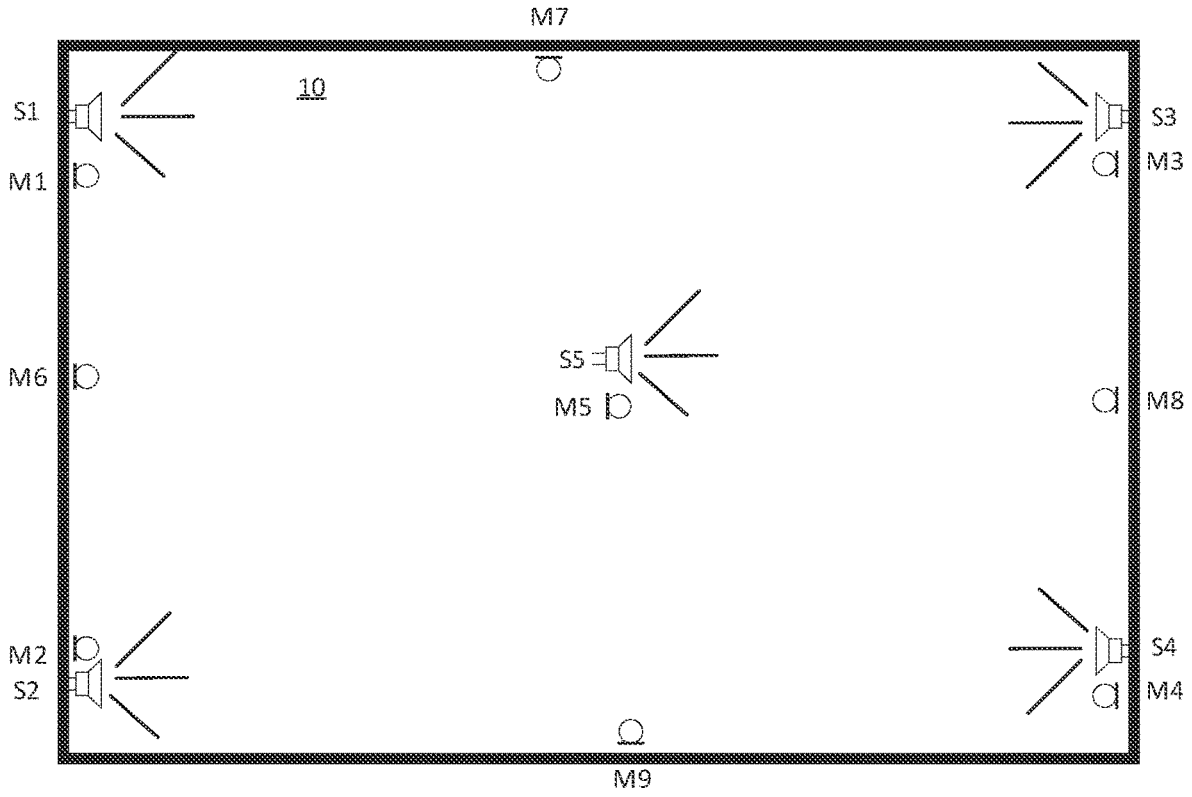
FIG. 7 is a drawing illustrating all speakers being turned on simultaneously.

FIG. 2 is a flowchart 200 illustrating a process for ensuring that the total SPL detected at any location meets the standard. Step 212 corresponds to the entirety of FIG. 1, so all of the adjusted settings have been determined, as illustrated in FIG. 6. Now, in step 214, all of the speakers S1-S5 are simultaneously activated with the test signal as shown in FIG. 7, each speaker at its determined adjusted SPL as shown in the FIG. 6 table. For example, S1 is activated at 79 dBA, S2 at 83 dBA and so on.

At step 216, with all of the speakers simultaneously activated, SPL measurements are taken for each microphone location. If the required SPL (in this example, 96 dBA) is not met at any one or more of the locations, as determined at step 220, one or more speakers will have to be adjusted upward, i.e., made louder (step 225). This process may be repeated with the newly adjusted settings until the standard is satisfied, i.e., each microphone reads at least 96 dBA.

The determined SPL may be chosen to optimize understandability of audio warnings. For example, in an exemplary system with four speakers where one of the speakers is blatantly affecting the intelligibility of the system/room, the SPL of that speaker may be reduced while still having the system maintain total SPL requirements. For example, 85 dBA may be required during a fire (NFPA standard), while only 43 dBA is needed for background music (per the customer's specifications).

Different test signals may be available for different types of audible output. For example, the test for a 520 Hz alert may simply comprise a 520 Hz square wave in a pattern such as one long pulse, followed by three short pulses. The test for a voice alert may comprise a brief vocal utterance. Each audio output device may have a separate SPL setting corresponding to each of the different alert types. In that case the entire flow of FIG. 1 is repeated for each alert type.

Figures 8, 9:
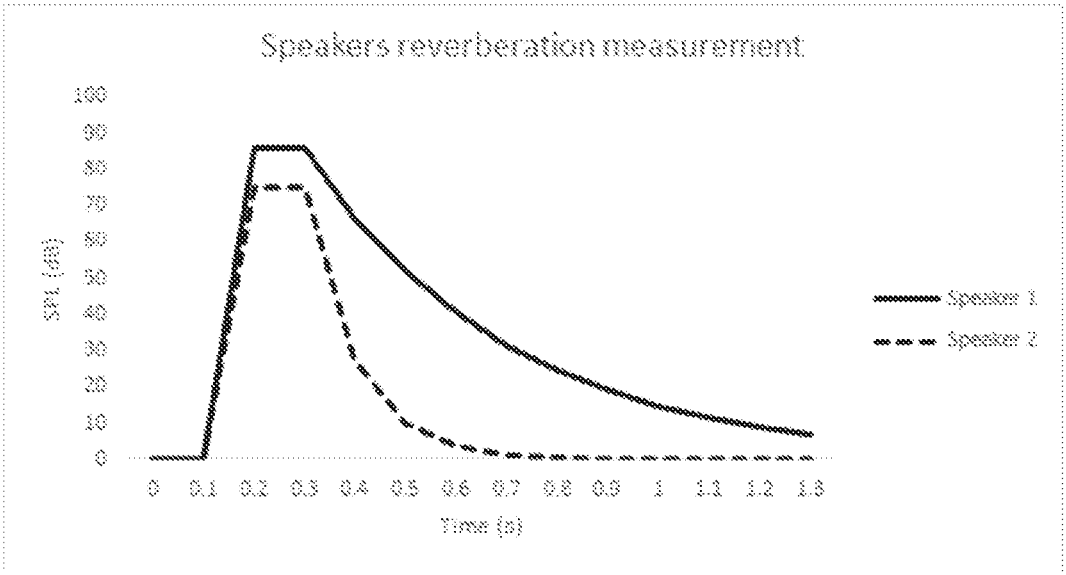
FIG. 8 is a table illustrating determined SPLs for five speakers for five different alarm or alert types.
FIG. 9 is a graph illustrating reverberation for two speakers at a single location.

An audio output device may be able to deliver various types of alerts, such as a synthesized bell, a siren, a voiced announcement, background music, etc., and each of these alerts may comprise different frequencies and may require a different test signal optimized for that alert type; so the entirety of the process described in FIG. 1 may be repeated for each test signal. Then the results, after adjustments for all of the speakers for all of the tests, may be recorded as illustrated in the table of FIG. 8. Thus, when a certain type of alert is called for, each speaker can be set to its determined (and recorded) SPL setting for that alert type can be looked up from the table, guaranteeing a reduced reverberation at each of the tested locations (where the microphone are positioned).

Figure 3:
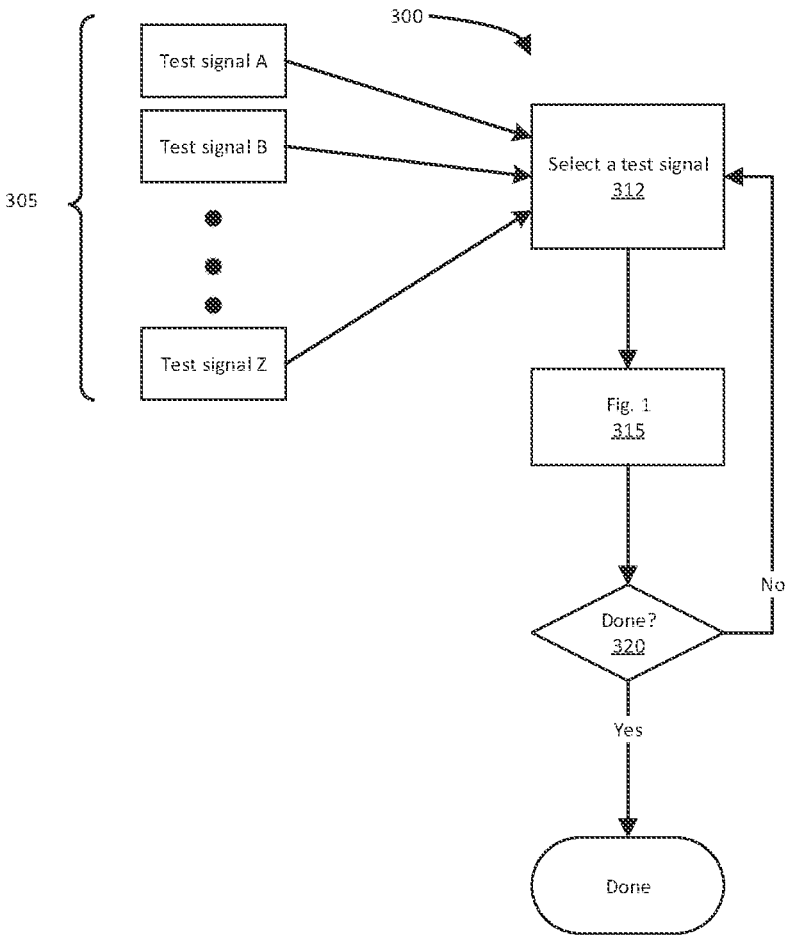
FIG. 3 is a flowchart illustrating the application of one or more test signals to adjust sound pressure for different sound pressure level requirements and message frequency signatures.

FIG. 3 is a flowchart 300 illustrating an exemplary method improving intelligibility due to reverberation effects for different alert types. First, in step 312, a test signal is selected from a set 305 of two or more test signals (Test Signal A, Test Signal B and so on). Various types of test signals may include, but are not limited to: 520 Hz or some other frequency or combination of frequencies such as pink or white noise, using some pattern such as three short pulses followed by a long pulse.

After having selected a test signal, all of the steps of FIG. 1 are performed (step 315 in FIG. 3). Alternatively, all of the steps of FIG. 2, which includes the steps of FIG. 1) may be performed. This is repeated (step 320) for each Test Signal. For example, as illustrated in FIG. 8, the SPL settings for each speaker are shown in each column for a 520 Hz alarm, a siren, a bell, a voice announcement, and background music, respectively.

It should be understood that that sound analyzer could be a discrete unit that receives the audio signals directly from the microphones and performs all of the calculation and determines the best output SPL settings. Alternatively, the analyzer may be distributed, with some or all of the process being performed at a control panel, or right at the audio output device, especially if the microphone is collocated with the audio output device. A discrete analyzer may perform some of the process in conjunction with a control panel and/or audio output devices.

For example, a microphone itself may evaluate the reverberation time and send that to a processing unit that determines the SPL. It is not necessary that the audio analyzer determine the amount of reverberation.

Though control panels are not shown, they are typically remote from the monitored space. For example, a single control panel may be located in a building lobby though it monitors an entire building, and multiple control panels may be networked throughout a large building, campus, airport, etc. Control panels microcontrollers and memory for storing programs for the microprocessors and for storing other information, such as the information illustrated in the table of FIG. 8.

I claim:

1. A method, comprising:

a) selecting a test signal;

b) generating the selected test signal;

c) selecting an audio output device from a plurality of audio output devices:

d) converting the generated test signal to an audio test signal at said audio output device at a predetermined sound pressure level (SPL);

e) for each microphone of a selected group of one or more microphones, each microphone having a corresponding location:

i. converting sound to an electrical signal at said microphone, and ii. determining from the electrical signal an amount of reverberation of the audio test signal at said microphone's location;

f) repeating steps c, d and e for each audio output device from the plurality of audio output devices;

g) adjusting first SPL settings of the selected audio output devices based on the determined amounts of reverberation;

h) simultaneously sounding the corresponding audio test signal from the plurality of audio output devices;

i) measuring, for each corresponding location a corresponding total SPL of the corresponding audio test signal in response to the corresponding audio test signal from the plurality of audio output devices;

j) adjusting a second SPL setting of at least a second audio output device of the plurality of audio output devices in response to the corresponding measured total SPL and the corresponding amount of reverberation of the at least second audio output device.

2. The method of claim 1, wherein:

in step a, the test signal is selected from a plurality of test signals, each of said plurality of test signals corresponding to a particular condition from a set of conditions;

in step d, the predetermined SPL for the selected audio output device corresponds to the particular condition; and in step g, the first SPL settings are adjusted based on the particular condition.

3. The method of claim 2, wherein steps a through g are repeated for each condition from the set of conditions.

4. The method of claim 2, wherein the set of conditions comprises at least one of: fire alarm; active shooter; weather warnings; background music; or general announcements.

5. The method of claim 2, wherein the plurality of test signals comprises at least one of: a slow whoop; a fast whoop; a horn; a bell; voice; or music.

6. The method of claim 2, wherein the plurality of audio output devices comprises at least one of: a speaker; a horn; a bell; a siren; or a buzzer.

7. The method of claim 1, wherein adjusting the first SPL settings comprises lowering a third SPL setting of a third audio output device with greatest reverberation.

8. The method of claim 1, wherein adjusting the first SPL settings comprises raising a fourth SPL setting of a fourth audio output device with least reverberation.

9. The method of claim 1, wherein the selected group of one or more microphones is located within a predetermined area.

10. The method of claim 1, wherein at least one of said selected group of one or more microphones is collocated with one of the selected audio output devices.

11. A system comprising:

a control panel;

an audio test signal generator;

a plurality of speakers located in a zone;

an audio signal analyzer;

one or more microphones placed at one or more locations within the zone;

wherein the control panel is configured to:

generate a test signal, select one of said plurality of speakers, and cause the selected speaker to emit, based on the generated test signal, an audio test signal at a predetermined sound pressure level (SPL);

wherein each of the selected microphones is configured to:

detect sound, convert its respective detected sound to a respective electrical audio signal, and send its respective electrical audio signal to the audio signal analyzer;

wherein the audio signal analyzer is configured to:

determine an amount of reverberation of the audio test signal at each of the selected microphones, and based on the amount of reverberation at each of the selected microphones, determine a SPL setting for the selected speaker;

wherein the control panel is further configured to:

cause the plurality of speakers to emit the audio test signal at the predetermined SPL wherein the audio analyzer is further configured to:

determine a corresponding total SPL setting in response to the audio test signal from the plurality of speakers.

12. The system of claim 11, wherein the audio test signal generator is at least one of a control panel, an audio signal generator, or one or more of said plural speakers.

13. The system of claim 11, the determined SPL setting is chosen to optimize intelligibility of audio warnings.

14. The system of claim 11, wherein a fire alarm panel is further configured to adjust a SPL of the selected speaker based on the determined SPL setting.

15. A method comprising:

a) sequentially sounding an audible test signal from a plurality of audio output devices;

b) at each of one or more locations, measuring a corresponding reverberation time of the sounded audible test signal for each audio output device of the plurality of audio output devices;

c) adjusting a first output sound pressure level (SPL) of at least a first audio output device of the plurality of audio output devices in response to the measured reverberation time;

d) simultaneously sounding the audible test signal from the plurality of audio output devices;

e) at each of the one or more locations, measuring a corresponding total SPL of the sounded audible test signal in response to the audible test signal from the plurality of audio output devices; and f) adjusting a second output SPL of at least a second audio output device of the plurality of audio output devices in response to the corresponding measured total SPL and said corresponding measured reverberation time of the at least second audio output device.

16. The method of claim 15, wherein adjusting the first output SPL of at least the first audio output device comprises deriving an index value from the reverberation times measured at each of the one or more locations for said first audio output device, and at least one of:

raising the first output SPL of said first audio output device having a first index value indicative of a shortest total reverberation time, and lowering the first output SPL of said first audio output device with a second index value indicative of a longest total reverberation time.

17. The method of claim 15, further comprising the step of:

h) repeating steps a through c for a plurality of audible test signals, each audible test signal corresponding respectively to at least one of a plurality of audible output types.

18. The method of claim 17, wherein the plurality of audible output types includes any of a buzzer, bell, siren, whoop, voiced public announcement, or background music.

19. The method of claim 18 further comprising maintaining a set of SPL values for each audible output type.

20. A system comprising:

a controller;

a plurality of audio output devices controlled by the controller;

a memory for storing SPL settings for each of the plurality of audio output devices for each of at least one or more audio alert types; and an audio sensor at each of one or more locations;

wherein the controller is configured to cause each of the plurality of audio output devices to sequentially sound an audible test signal, wherein at each of one or more locations, a reverberation time of the sounded audible test signal is measured for each audio output device;

wherein a first output sound pressure level (SPL) setting of at least a first audio output device of the plurality of audio output devices is adjusted in a table in response to the measured reverberation time;

wherein the controller is configured to cause the plurality of audio output devices to sound the audible test signal;

wherein at each of the one or more locations, a corresponding total SPL of the sounded audible test is measured in response to the audible test signal from the plurality of audio output devices; and wherein a second output SPL of at least a second audio output device of the plurality of audio output devices is adjusted in response to the measured total SPL and the corresponding measured reverberation time of the at least second audio output device.

21. The system of claim 20, wherein the controller is one or a combination of any of a fire alarm control panel, an intrusion control panel, a security control panel, or a building management system control panel.

22. The system of claim 20, wherein the table is stored in and maintained by the controller.

* * * * *